US008839810B1

(12) United States Patent
Ellis et al.

(10) Patent No.: US 8,839,810 B1
(45) Date of Patent: Sep. 23, 2014

(54) MANWAY COVER WITH INTEGRATED CLEANING SYSTEM

(71) Applicants: Stan Ellis, Bakersfield, CA (US); Travis Ellis, Bakersfield, CA (US)

(72) Inventors: Stan Ellis, Bakersfield, CA (US); Travis Ellis, Bakersfield, CA (US)

(73) Assignee: Vertical Tank, Inc., Bakersfield ( * ) Notice: Subject to any disclaimer, the term of this patent is extended or adjusted under 35 U.S.C. 154(b) by 31 days.

(21) Appl. No.: 13/740,077

(22) Filed: Jan. 11, 2013

(51) Int. Cl.
*B08B 3/02* (2006.01)
*B08B 9/093* (2006.01)

(52) U.S. Cl.
CPC ..... *B08B 9/093* (2013.01)
USPC ..... 137/240; 134/167 R; 134/99.1; 134/103.3

(58) Field of Classification Search
USPC ..... 137/237, 240; 251/144; 134/167 R, 134/168 R, 99.1, 103.3, 172
See application file for complete search history.

(56) References Cited

U.S. PATENT DOCUMENTS

| | | | | |
|---|---|---|---|---|
| 4,632,068 | A * | 12/1986 | Appleman et al. | 122/34 |
| 6,192,905 | B1 * | 2/2001 | Mincy et al. | 134/167 R |
| 6,213,135 | B1 * | 4/2001 | Moulder | 134/167 R |
| 7,264,009 | B2 * | 9/2007 | Gregory | 134/167 R |
| 7,320,329 | B2 * | 1/2008 | Luke et al. | 134/167 R |
| 7,507,298 | B2 * | 3/2009 | Falster-Hansen et al. | 134/167 R |
| 8,196,523 | B2 * | 6/2012 | Blevins, Jr. | 105/377.08 |

* cited by examiner

*Primary Examiner* — Kevin Lee
(74) *Attorney, Agent, or Firm* — Matthew C. McCartney, Esq.; Eastman & McCartney LLP

(57) ABSTRACT

A manway cover for use with a storage enclosure, for example an enclosed tank, includes an interior surface and an exterior surface. A fluid line connector is attached to the exterior surface of the manway cover for releasable attachment of a fluid line thereto. A rotatable spray nozzle is attached to the interior surface of the manway cover and is in fluid communication with the fluid line connector. When a fluid line is connected to the fluid line connector, fluid flows from the fluid line connector to the spray nozzle, whereupon it is sprayed into the interior of the tank.

14 Claims, 3 Drawing Sheets

MANWAY COVER WITH INTEGRATED CLEANING SYSTEM

RELATED APPLICATIONS

Not Applicable.

BACKGROUND OF THE INVENTION

1. Field of the Invention

The present invention relates generally to a manway cover, and more specifically to a manway cover with an integrated cleaning system for cleaning a tank or other enclosed structure.

2. Background

Enclosed storage structures such a tanks are well known in the art. These storage enclosures are used to store a wide variety of liquids and solids, depending on the industry in which the storage enclosure is being used. In the oil and gas industry, for example, holding tanks and shipping tanks are used in oil field production. Further, storage tanks are used to hold fluids used in hydraulic fracturing ("fracking"). Some of these fracking tanks are enclosed structures, where human access to the interior of the tank is limited to a manway. These fracking fluids, which may contain relatively high levels of solids such as sand, are stored until their use at the job site. The interior of the tanks described above, as well as a variety of other enclosed tanks, must be cleaned regularly to ensure proper fluid flow and a "clean" course of fluids for downstream use. Cleaning the interior of enclosed tanks and other structures presents a variety of challenges.

Access to the interior of steel tanks such as those described above is generally via a manway that is closed and sealed with a manway cover. This limited access makes it difficult for an individual to position himself to properly clean the interior of the tank using a hose or other mechanism for introducing water or cleaning fluid into the tank. Further, cleaning methods that require an individual to enter the tank in order to properly clean the interior expose the individual to the substances that were stored within the tank, some of which may be hazardous or otherwise undesirable.

Tanks may be designed to make cleaning easier, however a large number of existing tanks are used across various industries, and the tanks have a relatively long lifespan. The cost of the tanks coupled with the remaining long life of existing tanks provides a disincentive to replace existing tanks for a newer model that may be easier to clean. What is needed is an effective cleaning system for use with steel tanks and other storage enclosures accessed via manways, the system being capable of easy retrofit to a wide variety of existing tanks.

SUMMARY OF THE INVENTION

The present invention provides a manway cover for use with an enclosed structure such as an enclosed tank. The manway cover includes an interior surface and an exterior surface. A fluid line connector is attached to the exterior surface of the manway cover for releasable attachment of a fluid line thereto. A rotatable spray nozzle is attached to the interior surface of the manway cover and is in fluid communication with the fluid line connector. When a fluid line is connected to the fluid line connector, fluid flows from the fluid line connector to the spray nozzle, whereupon it is sprayed into the interior of the tank.

In another embodiment of the invention, the manway cover includes a fluid conduit extending from the fluid line connector, through the manway cover, and to the rotatable spray nozzle.

In another embodiment of the invention, the manway cover includes a handle attached to the exterior surface of the manway cover for opening and closing the manway cover.

In another embodiment of the invention, flow of fluid through the spray nozzle causes rotation of the spray nozzle.

Another embodiment of the invention provides a manway cover for cleaning the interior of a tank. The manway cover includes an exterior surface and an interior surface. A fluid line connector is attached to the exterior surface of the manway cover. An extension arm is attached to the interior surface of the manway cover and extends away therefrom. The extension arm is in fluid communication with the fluid line connector. A spray head is attached to the extension arm and is in fluid communication with the extension arm. When a fluid line is connected to the fluid line connector, fluid flows to the spray head and is sprayed into the interior of the tank.

In another embodiment of the invention, the spray head is rotatably attached to the extension arm.

In another embodiment of the invention, the extension arm is rotatably attached to the interior of the manway cover.

In another embodiment of the invention, the spray head includes a spray nozzle through which fluid is sprayed.

In another embodiment of the invention, the rotation of the spray head and extension arm are automated.

In another embodiment of the invention, rotation of the spray head and extension arm are programmable.

Another embodiment of the invention provides a system for cleaning the interior of a tank. The system includes a manway cover having an interior surface and an exterior surface, a fluid line connector attached to the exterior surface of the manway cover, and a fluid sprayer attached to the interior surface of the manway cover. The fluid sprayer is in fluid communication with the fluid line connector.

In another embodiment of the invention, the fluid sprayer is rotatable.

In another embodiment of the invention, the fluid sprayer is releasably attached to the interior surface of the manway cover.

In another embodiment of the invention the manway is sized and shaped to replace an existing manway cover in an existing tank.

DETAILED DESCRIPTION OF THE INVENTION

Figure 1:
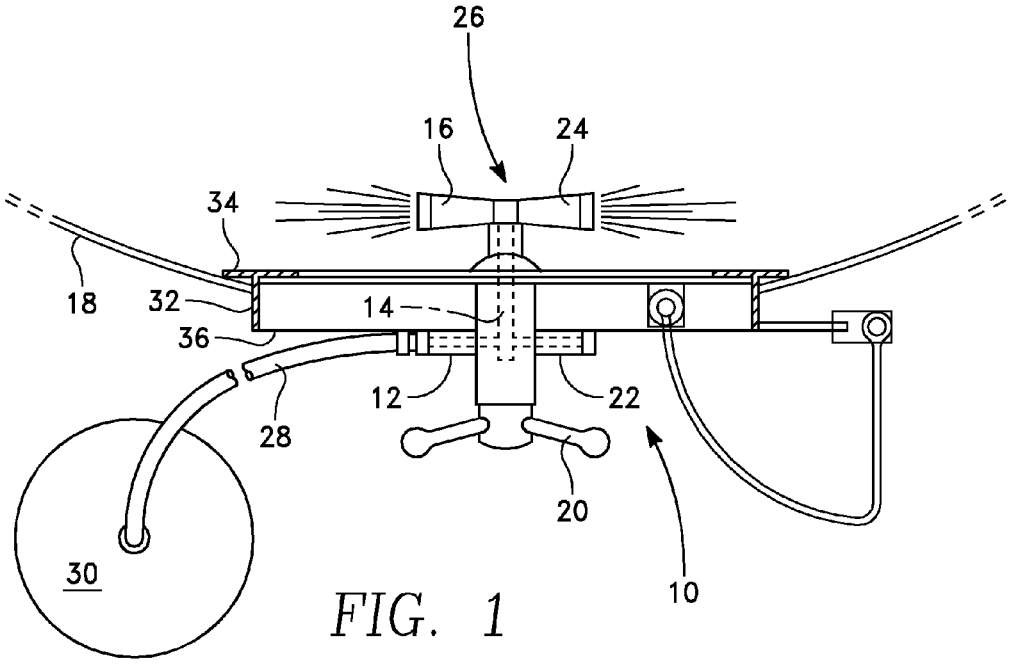
FIG. 1 is a side view of one embodiment of the present invention showing a cross-section of a tank wall with a manway cover with integrated cleaning system.

The present invention provides a manway cover with an integrated cleaning system for cleaning the interior of a storage enclosure such as a holding tank, shipping tank, closed-top hydraulic fracturing tank, or other enclosed tank. The cleaning system may be detachable, such that it can be removed from the interior of structures storing fluids with relatively high solids contents. Because the cleaning system is integrated with a storage tank manway cover, existing tanks are easily retrofitted to use the present invention. Existing manway covers are simply replaced with the manway cover with integrated cleaning system of the present invention.

Turning to the drawings, wherein like numerals indicate like parts, the numeral 10 refers generally to a manway cover of the present invention. Manway cover 10 includes a fluid line connector 12 attached to an exterior surface thereof and a spray head 26 having a first spray nozzle 16 and second spray nozzle 24 attached to an interior surface thereof. A conduit 14 extends between fluid line connector 12 and spray head 26, allowing fluid communication therebetween.

FIG. 1 shows a close view of a manway cover 10 within a section of tank wall 18. Tank wall 18 may be part of an enclosed hydraulic fracking tank or any other tank having a manway for access. The manway cover 10 shown in FIG. 1 includes a rotatable handle 20 to allow a user to open, close, and lock the manway cover. It is to be understood, however, that a wide variety of manway covers exist in the art, having a wide variety of structural features, opening and closing mechanisms, and the like. Although specific manway covers are shown in the drawings for purposes of illustrating the principles of the present invention, the present invention may be used with any suitable manway cover, regardless of size, shape, or specific structural features.

Manway cover 10 includes a first fluid line connector 12 attached to an exterior surface thereof. Such connectors are known in the art, and it is contemplated that any suitable connector may be used with respect to the present invention. Fluid line connector 12 allows for releasable attachment of a fluid line 28 thereto. When fluid line 28 is attached to first fluid line connector 12, fluid may be delivered from a fluid source such as reservoir 30 to first fluid line connector 12. In the embodiment of the device shown in FIG. 1, a second fluid line connector 22 is also provided. The second fluid line connector may allow for a second fluid line to be attached to manway cover 10 in addition to fluid line 28, or may provide another option for attachment of fluid line 28 when only one fluid line connector is being used. It is contemplated that in embodiments of the present invention having more than one fluid line connector, any fluid line connectors not in use during operation of the present device remain closed so that fluid does not leave the system through an open and unused connector. Any desired number of fluid line connectors may be provided, or a single connector having multiple attachment portions may be provided so that more than one fluid line may be attached to a single connector or the attachment location of a single fluid line to a single connector may be varied.

Manway cover 10 includes a body 32 extending between the interior surface 34 and exterior surface 36 thereof. A conduit 14 extends through body 32 of manway cover 10, providing a route for fluid flow through manway cover 10. Fluid line connector 12 is in fluid communication with conduit 14. A rotatable spray head 26 is attached to the interior surface of manway cover 10. Rotatable spray head 26 is also in fluid communication with conduit 14. In the embodiment of the present invention shown in FIG. 1, spray head 26 includes a first spray nozzle 16 and a second spray nozzle 24. It is contemplated that any suitable spray head, or any suitable number or configuration of spray nozzles may be used in accordance with the teachings of the present invention.

When the embodiment of the present invention shown in FIG. 1 is in use, fluid, such as cleaning fluid, is pumped from reservoir 30 through fluid line 28 to fluid line connector 12. The fluid then moves through conduit 14 and into spray head 26. The movement of fluid into spray head 26 preferably causes rotation of spray head 26. Fluid then exits through first and second spray nozzles 16 and 24, respectively, and is introduced onto the interior surface of the tank.

Figure 2:
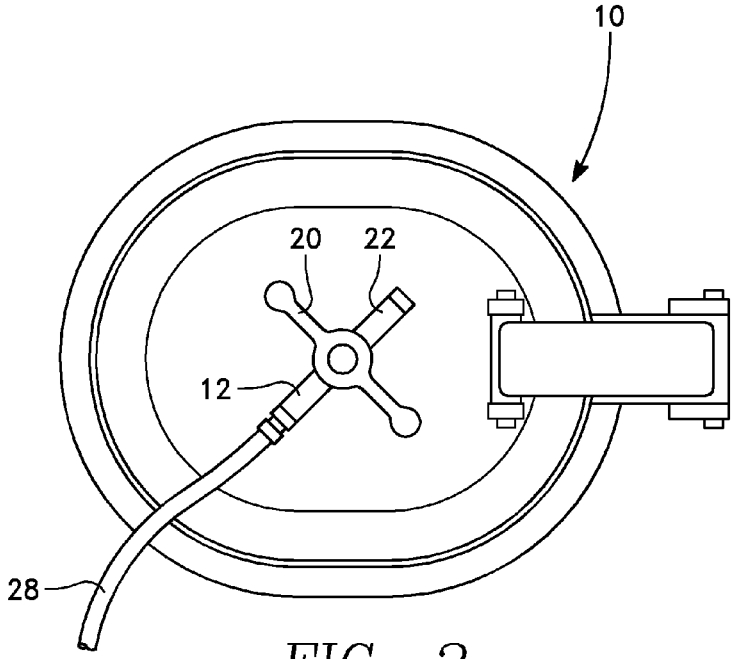
FIG. 2 is a top view of the manway cover of FIG. 1.

FIG. 2 is a top view of the embodiment of the present invention shown in FIG. 1. Shown in the figure are first fluid line connector 12, second fluid line connector 22, and fluid line 28. Handle 20 is also visible, as are various other structural elements of manway cover 10 that are not part of the present invention but instead represent standard features of manways covers known in the art.

Figure 3:
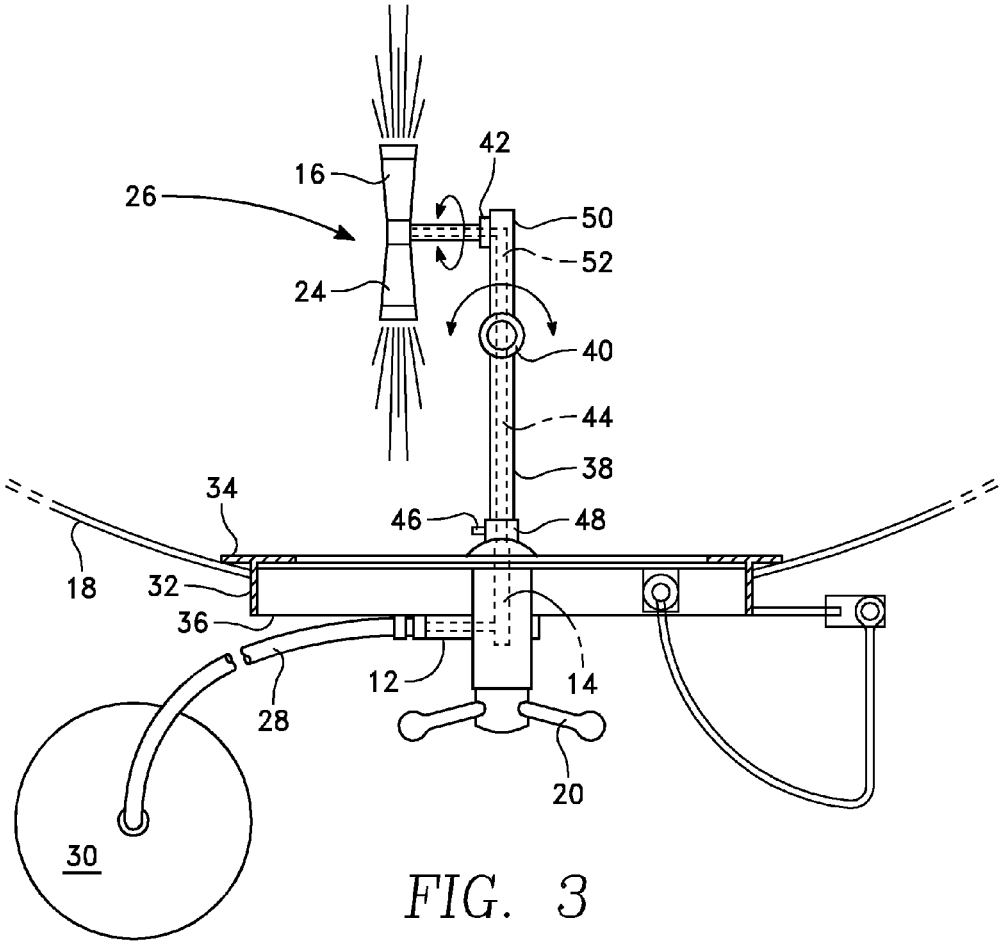
FIG. 3 is a side view of one alternative embodiment of the present invention showing a cross-section of a tank wall with a manway cover with integrated cleaning system.

FIG. 3 depicts one alternative embodiment of the present invention. In the embodiment of the invention shown in FIG. 3, the parts of the present invention on the exterior surface 36 of manway 10 are similar to those shown in FIG. 1. In the embodiment shown in FIG. 3, however, only a single fluid line connector 12 is provided. The portion of the invention attached to interior surface 34 of manway 10 differs in a number of ways from that shown in FIG. 1.

The embodiment of the present invention shown in FIG. 3 includes an extension arm 38 attached to an attachment member 48. Attachment member 48 is fixedly attached to interior surface 34 of manway 10. Extension arm 38 is preferably removably attachable to attachment member 48. In the embodiment shown in the figure, a locking pin 46 is used to secure the attachment of extension arm 38 to attachment member 48. Any suitable attachment or locking mechanism may be used. Extension arm 38 includes a through hole 44 extending along the length thereof to allow fluid flow through extension arm 38.

A spray head support 50 is attached to extension arm 38, preferably in a swiveling manner. A first swivel joint 40 is shown in the Figure between extension arm 38 and spray head support 50. First swivel joint 40 includes a through hole (not shown) to allow fluid to pass from extension arm 38 into spray head support 50. In other embodiments of the invention, hoses or other conduits external to first swivel joint 40 maybe used to allow fluid flow between extension arm 38 and spray head support 50. Spray head support 50 includes a through hole 52 to accommodate fluid flow into the spray head support.

Spray head 26 is attached to spray head support 50, preferably also in a swiveling manner. Second swivel joint 42 is shown in the figure between spray head 26 and spray head support 50. As with first swivel joint 40, second swivel joint 42 includes a through hole (not shown) to allow fluid to pass from spray head support 50 into spray head 26. In other embodiments of the invention, hoses or other conduits external to second swivel joint 42 may be used to allow fluid flow between spray head support 50 and spray head 26. Spray head 26 includes two opposing spray nozzles 16 and 24 for introducing liquid into the interior of a tank.

Operation of the device shown in FIG. 3 is similar to the operation of the device of FIG. 1. Fluid from a reservoir 30 is pumped along fluid line 28 to first fluid line connector 12. The fluid enters the first fluid connector 12 and travels along conduit 14, through attachment member 48, and into extension arm 38. The fluid then travels along through hole 44, through first swivel joint 40, and into through hole 52 of spray head support 50. The fluid is directed through spray head support 50 and into spray head 26, whereupon the fluid is expelled through first and second spray nozzles 16 and 24. The movement of fluid through spray head 26 preferably causes rotational movement of spray head 26.

As noted above, extension arm 38 is preferably removably attached to attachment member 48. Such an embodiment is particularly suitable for tanks containing fluids with a high solids content that may damage or otherwise interfere with the operation of the present integrated cleaning system if left attached to the interior of the manway cover. It is contemplated, however, that some embodiments of the present invention may provide a fixed extension arm 38. In embodiments having a removable extension arm 38 it is contemplated that gaskets, seals, or other structures may be utilized at the point extension arm 38 connects to attachment member 48 in order to ensure a fluid-tight connection between extension arm 38 and attachment member 48.

As noted above, the embodiment of the present invention shown in FIG. 3 includes two swivel joints: first swivel joint 40 and second swivel joint 42. A variety of mechanisms may be used for rotating portions of the present invention around the swivel joints in order to change the positions of components of the invention. In some embodiments of the invention, the components of the present invention adjustable via the swivel joints may be manually positioned prior to use of the invention and may retain that manually-set position while the device is in use. Use of the device may be halted to re-adjust the positions of various components of the invention as necessary or desired.

In addition to manual adjustment, the present invention may include a mechanism for powered adjustment of components of the device around swivel joints. A variety of mechanisms for making such adjustments are known in the art and may be used with the present invention. In such embodiments, the positions of various components of the present invention may be adjusted without a user coming into physical contact with the components of the present invention on the interior of the manway cover. Adjustment to the positions of various components may be made with a keypad on the exterior of the manway cover, with a remote device in communication with the powered portions of the present invention, or in any other manner suitable to the invention. Once the positions are set, they may be maintained during the cleaning process. Alternatively, the powered components of the invention may be programmed to rotate among various positions, or to rotate at various speeds, and the like.

Spray head 26 may be caused to rotate automatically by passage of fluid therethrough. Such spray heads are known in the art, and it is contemplated that a spray head having such functionality may be incorporated into the present invention.

Figure 4:
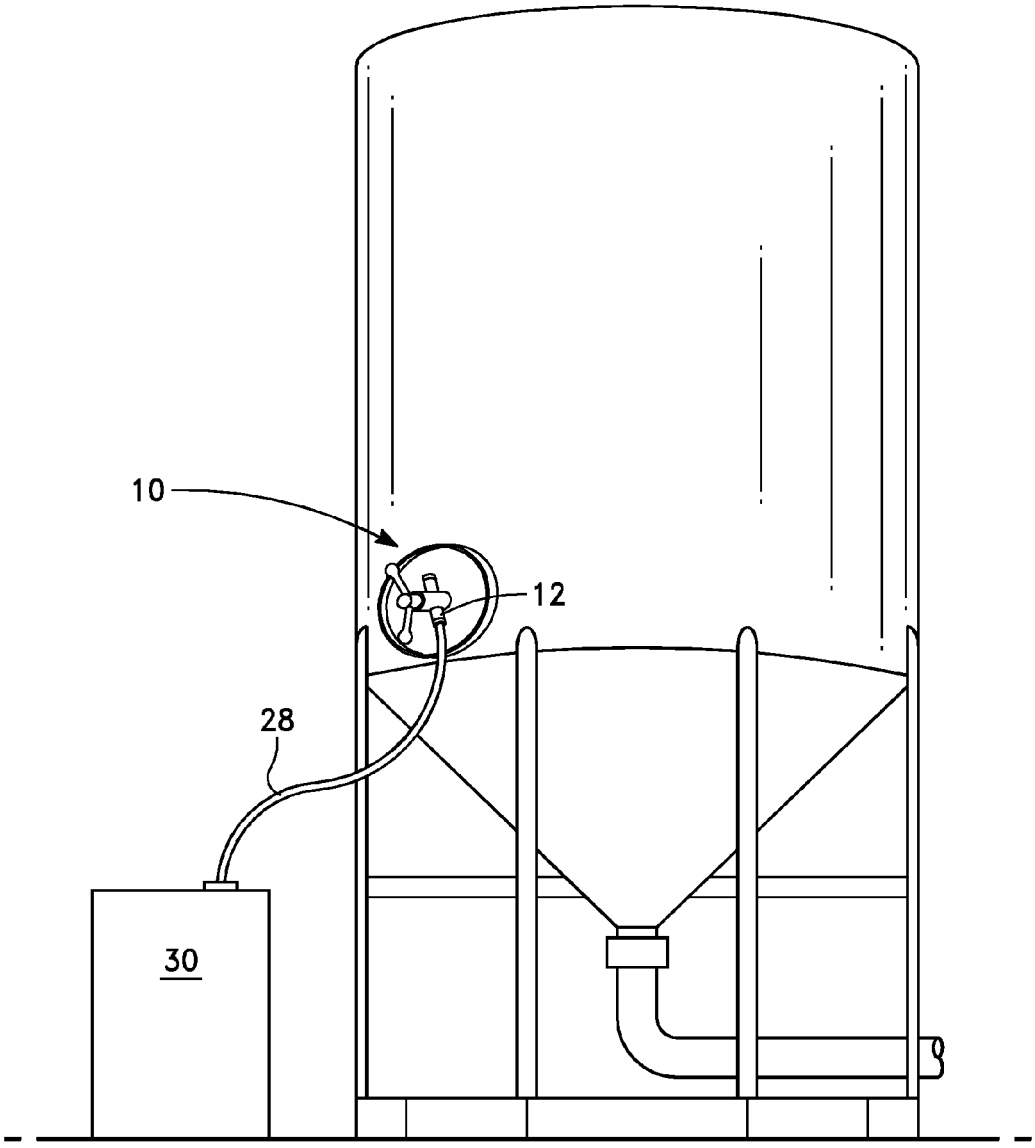
FIG. 4 is a perspective view of a vertical steel tank having a manway cover and cleaning system according to the present invention associated therewith.

FIG. 4 is a perspective view of an enclosed vertical tank having a manway cover 10 and other components of the present invention associated therewith. As shown in the drawing, manway cover 10 has a fluid line connector 12 attached thereto. Fluid line connector 12 is releasably connected to fluid line 28, which is in fluid communication with a fluid reservoir 30. The manway cover and cleaning system depicted in FIG. 4 works substantially as described above with respect to other embodiments of the invention.

In addition to the various embodiments of the present invention described above, it is also contemplated that rotating spray heads or spray jets existing in the art may be utilized in the accordance with the principles of the present invention. Exemplary such devices are produced by Scanjet Systems (Göteborg, Sweden), which also does business as Orbijet Technologies (Houston, Tex., USA). It is not currently known to use such devices with a manway cover as described herein, however upon reading this disclosure the mechanism by which such devices can be used in accordance with the present invention will be apparent to those having skill in the art. Any of the mechanisms for spraying fluid used in conjunction with the present invention, whether existing in the art or developed specifically for the present use, may be referred to generally as a "sprayer" or "fluid sprayer."

Devices for pumping fluid are well known in the art, and no pump is shown in the Figures. It is contemplated that any suitable fluid pump may be used to pump fluid from reservoir 30 along fluid line 28. Further reservoir 30 may be any suitable structure for containment of fluid. Thus, reservoir 30 may be another tank, a carboy, a drum, or other container.

It is understood that the foregoing description and the accompanying figures are exemplary of the shown and described embodiments of the present invention. Various modifications to the invention will be readily apparent to those of skill in the art upon reading this disclosure, and it is contemplated that such modifications remain within the spirit and scope of the invention.

Having thus described the preferred embodiment of the invention, what is claimed as new and desired to be protected by Letters Patent includes the following:

1. A manway cover for use with a hydraulic fracking tank, the manway cover comprising:
- an exterior surface;
- an interior surface;
- at least two fluid line connectors attached to the exterior surface of the manway cover and each capable of receiving a single fluid line;
- at least two fluid lines wherein each fluid line is releasably attached to each fluid line connector;
- a rotatable spray head having a plurality of spray nozzles, wherein the rotatable spray head is attached to the interior surface of the manway cover and in fluid communication with the fluid line connectors; and
- wherein a fluid flows from said fluid lines, through said fluid line connectors, through said spray nozzles and sprays into an interior of a tank.

2. The manway cover according to claim 1 further comprising a fluid conduit extending from the fluid line connectors through the manway cover to the rotatable spray head for allowing fluid communication therebetween.

3. The manway cover according to claim 1 further comprising a handle attached to the exterior surface of the manway cover for opening and closing the manway cover.

4. The manway cover according to claim 1 wherein flow of fluid through the spray nozzles causes rotation of the spray head.

5. A manway cover for cleaning the interior of a tank, the manway cover comprising:
- an exterior surface;
- an interior surface;
- a fluid line connector attached to the exterior surface of the manway cover and configured for releasable attachment of a fluid line;
- an attachment member attached to the interior surface of the manway cover and in fluid communication with the fluid line connector;
- an extension arm removably attached to the attachment member attached to the interior surface of the manway cover and extending away therefrom, the extension arm in fluid communication with the attachment member;
- a first swivel joint attached to and in fluid communication with the extension arm;
- a spray head support attached to and in fluid communication with the first swivel joint;
- a second swivel joint attached to and in fluid communication with the spray head support;
- a spray head attached to the second swivel joint and in fluid communication therewith; and
- wherein when the fluid line is connected to the fluid line connector and a fluid is delivered thereto, the fluid flows to the spray head and is sprayed into the interior of a tank, wherein the swivel joints allows articulation of the spray head support and the spray head to set positions.

6. The manway cover according to claim 5, wherein the spray head is rotatably attached to the spray head support.

7. The manway cover according to claim 6, wherein the extension arm is rotatably attached to the attachment member attached to the interior surface of the manway cover.

8. The manway cover according to claim 5, wherein the spray head comprises a spray nozzle and fluid is sprayed into the interior of the tank through the spray nozzle.

9. The manway cover according to claim 7, wherein rotation of the spray head and extension arm are automated.

10. The manway cover according to claim 9, wherein the rotation of the spray head and extension arm are programmable.

11. A system for cleaning the interior of a tank, the system comprising:

a manway cover having an interior surface and an exterior surface;

at least two fluid line connectors configured for releasable attachment of a fluid line attached to the exterior surface of the manway cover; and a fluid sprayer attached to the interior surface of the manway cover and in fluid communication with the fluid line connectors.

12. The system according to claim 11, wherein the fluid sprayer is rotatable.

13. The system according to claim 11, wherein the fluid sprayer is removably attached to the interior surface of the manway cover.

14. The system according to claim 11, wherein the manway cover is sized and shaped to replace an existing manway cover on a tank.

* * * * *